United States Patent [19]

Szkaradek et al.

[11] Patent Number: 4,742,966

[45] Date of Patent: May 10, 1988

[54] MEDIA MILL SCREEN ASSEMBLY

[75] Inventors: Edward J. Szkaradek, Santa Ana; John J. Corrigan, Garden Grove, both of Calif.

[73] Assignee: Morehouse Industries, Inc., Fullerton, Calif.

[21] Appl. No.: 784,865

[22] Filed: Oct. 4, 1985

Related U.S. Application Data

[63] Continuation-in-part of Ser. No. 746,440, Jun. 21, 1985, Pat. No. 4,624,418, which is a continuation-in-part of Ser. No. 627,918, Jul. 5, 1984, abandoned, and a continuation-in-part of Ser. No. 663,049, Oct. 19, 1984, Pat. No. 4,651,935.

[51] Int. Cl.[4] ..... B02C 17/16

[52] U.S. Cl. ..... 241/69; 241/171; 241/172

[58] Field of Search ..... 210/488–492; 241/69, 70, 72, 79, 79.2, 79.3, 153, 171, 172, 173, 174, 176

[56] References Cited

U.S. PATENT DOCUMENTS

| | | | |
|---|---|---|---|
| 3,397,794 | 8/1968 | Toth et al. | 210/488 |
| 3,563,388 | 2/1971 | Briggs | 210/457 |
| 3,648,843 | 3/1972 | Pearson | 210/443 |
| 3,780,957 | 12/1973 | Wilhelm | 241/172 |
| 3,814,334 | 6/1974 | Funk | 241/172 X |
| 4,146,481 | 3/1979 | Natatoshi et al. | 210/232 |
| 4,267,045 | 5/1981 | Hoof | 210/322 |
| 4,441,658 | 4/1984 | Szkaradek | 241/46.17 |

FOREIGN PATENT DOCUMENTS

| | | | |
|---|---|---|---|
| 95799 | 5/1939 | Sweden | 210/488 |

OTHER PUBLICATIONS

"Morehouse Horizontal Mill System HMS/T-1" brochure.

*Primary Examiner*—Mark Rosenbaum

*Attorney, Agent, or Firm*—Knobbe, Martens, Olson & Bear

[57] ABSTRACT

A media mill having a cylindrical vessel which is vertically oriented and a motor-driven rotor extending through the vessel to agitate grinding media and a liquid product within the vessel. A tubular outlet housing extends radially outward from the vessel and forms an opening through which a screen assembly is removably mounted. The screen assembly comprises a stack of adjacently positioned annular rings which are supported on a tubular carrier element. Adjacent screen elements retain the grinding media within the vessel while openings between the elements permit the milled product to flow therethrough and into an interior cavity terminating in an outlet. The screen assembly extends into the interior of the vessel and is removably secured to the outlet housing by a quick disconnect retainer means.

14 Claims, 2 Drawing Sheets

Fig. 1
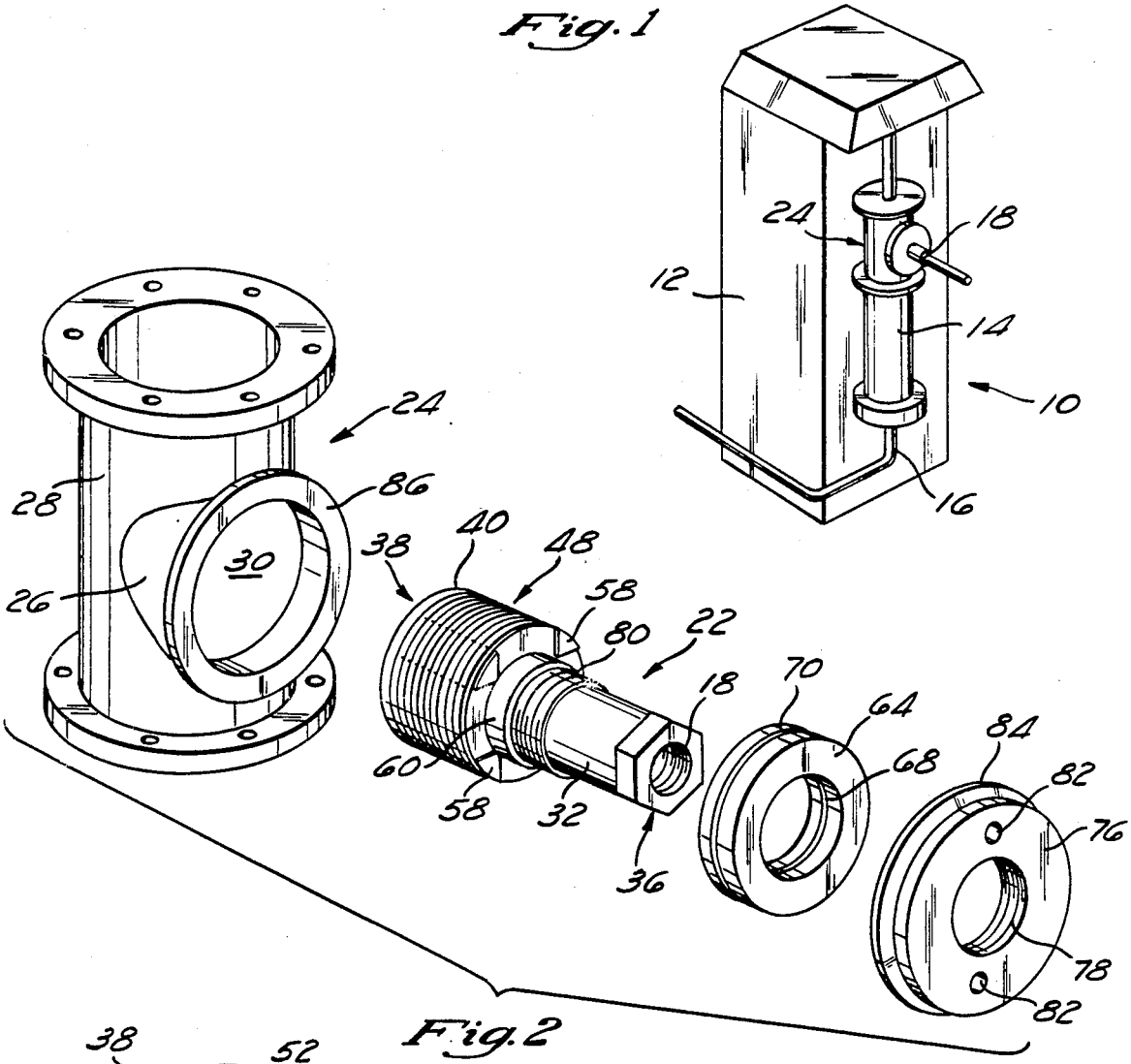
Fig. 2
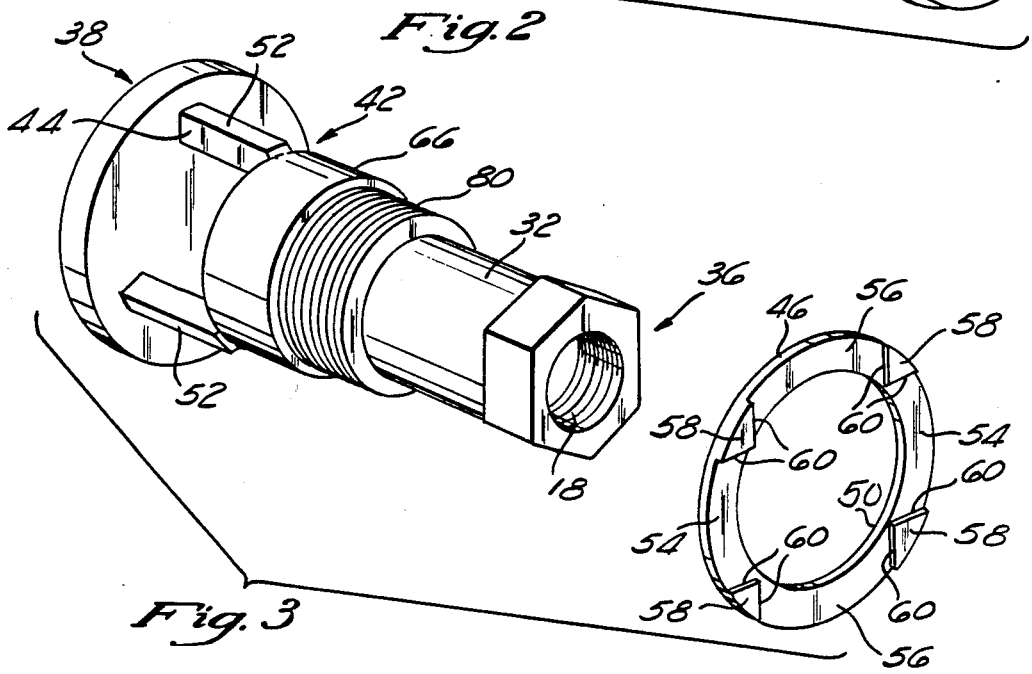
Fig. 3

MEDIA MILL SCREEN ASSEMBLY

RELATED APPLICATIONS

This application is a continuation-in-part of copending U.S. patent application Ser. No. 746,440, filed June 21, 1985, now U.S. Pat. No. 4,624,418, which in turn is a continuation-in-part of copending U.S. patent application Ser. No. 627,918, filed July 5, 1984, abandoned and co-pending U.S. patent application Ser. No. 663,049, filed Oct. 19, 1984 now U.S. Pat. No. 4,651,935.

BACKGROUND OF THE INVENTION

This invention relates generally to an improved outlet structure for a liquid processing vessel of a media mill, often referred to as a sand mill. In particular, the outlet structure includes an improved screen assembly and the related construction for mounting the screen assembly with respect to the sand mill vessel.

Sand milling is a proven, practical, continuous, high production method of dispersing and milling particles in liquid to produce smooth, uniform, finely dispersed products. Some of the products for which the sand milling process is used include paints, inks, dye stuffs, paper coatings, chemicals, magnetic tape coatings, insecticides, and other materials in which milling to a high degree of fineness is required.

In a typical sand milling process, the material or slurry to be processed is introduced at one end of the processing chamber or vessel and pumped through a small diameter grinding media while a rotor within the vessel agitates the media to insure proper milling and dispersion of small particles in the liquid or slurry being processed. Although the grinding media in years past was sand, more currently a small manufactured product of steel, glass or other material is used.

The processed liquid exits from the vessel, but the grinding media must, of course, remain within the vessel. To accomplish this, the outlet structure typically includes a screen assembly which prevents the media from leaving the vessel while the processed liquid flows through the screen. U.S. Pat. No. 4,441,658 issued Apr. 10, 1984 describes a cup-shaped assembly that fits within a cylindrical wall leading to an outlet. The cup shape of the screen assembly provides a large filtering surface area. Other screen assemblies include segments forming a portion of a cylindrical wall. These screen components are typically formed of small diameter rods or strands which are welded at their intersections. A shortcoming of these welded constructions is that the screen becomes worn, causing some of the strands of the screen to break or causing the openings between the strands to become large enough to allow passage of the grinding media. This requires early replacement of the screen.

It is also desirable that the screen assembly extend into the vessel so that the entire surface area of the screen is directly exposed to the flow of liquid through the vessel, and so that the grinding media cannot become lodged between the screen and closely surrounding walls, thus obstructing a portion of the screen. In Wilhelm (U.S. Pat. No. 3,780,957) a screen assembly for a media mill is shown in which a plurality of tubular screen cartridges extend into the internal space of the media mill vessel. However, since the screens extend into the vessel they are subject to even greater wear by the abrasive grinding media. The system in Wilhelm is unsatisfactory since the screening wears too quickly.

Thus, a need exists for an improved longer lasting screen construction for a media mill. The screen vessel, together with the outlet structure must also be arranged so as to provide easy disassembly for cleaning or replacement of the screen components.

SUMMARY OF THE INVENTION

The present invention comprises a screen assembly for retaining solid particles within a vessel and permitting liquid to exit the vessel. The screen assembly includes a plurality of preferably ring-shaped screen elements which are arranged with their axial faces abutting to form a stack having an inner void. One axial face of each screen element has a plurality of slots therein. The slots and the axial faces of the adjacent screen elements form openings which allow liquid to flow through the stack and into the inner void. The openings are sized to prevent media from passing through the stack, and thus when the stack of screen elements is positioned adjacent an outlet in the vessel, the media is prevented from exiting the vessel while the liquid exits.

To support the screen elements within the vessel in a stacked configuration, the screen assembly further comprises a tubular carrier which extends through the inner void created by the stacked screen elements. An interior channel within the carrier terminates in a liquid outlet at the end of the carrier which is outside the vessel. The end of the carrier within the vessel is closed, and the stack is retained on the carrier near the closed end. The screen elements surround one or more windows through the carrier which allow fluid communication between the openings in the stack and the interior channel. The carrier is removably fastened to the vessel so that the screen elements can be accessed for cleaning or replacement. Since all of the screen elements are stacked together on the carrier, the screen elements together with the carrier are easily inserted and removed from the vessel without requiring manipulation of each of the individual screen elements.

Preferably, the screen assembly is utilized in combination with a media mill having a vessel in which liquid product and a grinding media are agitated by a rotor. The liquid is introduced to the vessel through a liquid inlet and exits through a tubular outlet housing which extends radially outward from the vessel and terminates in an open end. The carrier is inserted through the open end of the outlet housing so that the grinding media can be filtered from the liquid before the liquid exits the vessel.

The carrier is fastened to the outlet housing by an annular face plate having internal threading which mates with external threading on a threaded portion of the carrier. A peripheral flange on the face plate mates with a flange surrounding the open end of the outlet housing. The flanges are clamped together by a quick disconnect retainer ring which prevents the face plate and carrier from sliding out of the outlet housing.

In a preferred embodiment, the stack of screen elements extend beyond the outlet housing and into the vessel so that the openings between the screen elements are directly exposed to the flow of liquid through the vessel. An annular spacer is provided to retain the stack on the carrier and to space the stack from the face plate sufficiently for the stack to extend into the vessel. The spacer slides over the carrier and abuts the stack on one side and abuts the face plate on the other side. With the stack extending into the vessel, as opposed to being surrounded by the outlet housing, the entire surface area of the openings can be utilized to filter the liquid. Further, grinding media cannot obstruct flow through the openings by becoming wedged between the outlet housing and the openings, whereas there is some tendency to do this if the stack is located within the outlet housing.

To reduce the pressure drop across the screen elements, the slots are formed with straight edges that extend uninterrupted from the outside diameter of the screen elements to the inside diameter.

In order to retain the stack on the carrier, a planar, preferably integral, end plate is positioned at the closed end of the carrier. The end plate is in a plane which is normal to the central axis of the carrier. The end plate protrudes beyond the periphery of the carrier so as to prevent the screen elements from sliding off the carrier. Preferably, the end plate is circular and has a diameter which is greater than the inside diameter of the screen elements. In a preferred arrangement, the windows through the carrier are formed by spaces between ribs which extend from the end plate to the remainder of the carrier. The ribs preferably are oriented parallel to the central axis of the carrier and the radially inner edges of the screen elements rest on the radially outer edges of the screen elements to support the ribs in a coaxial, stacked configuration.

BRIEF DESCRIPTION OF THE DRAWINGS

FIG. 1 is a perspective view of a media mill incorporating the present invention;

FIG. 2 is an exploded perspective view of the outlet structure of a media mill and a screen assembly according to the present invention;

FIG. 3 is a perspective view of the carrier element and a single screen element of the present screen assembly;

DETAILED DESCRIPTION OF THE PREFERRED EMBODIMENT

Figure 4:
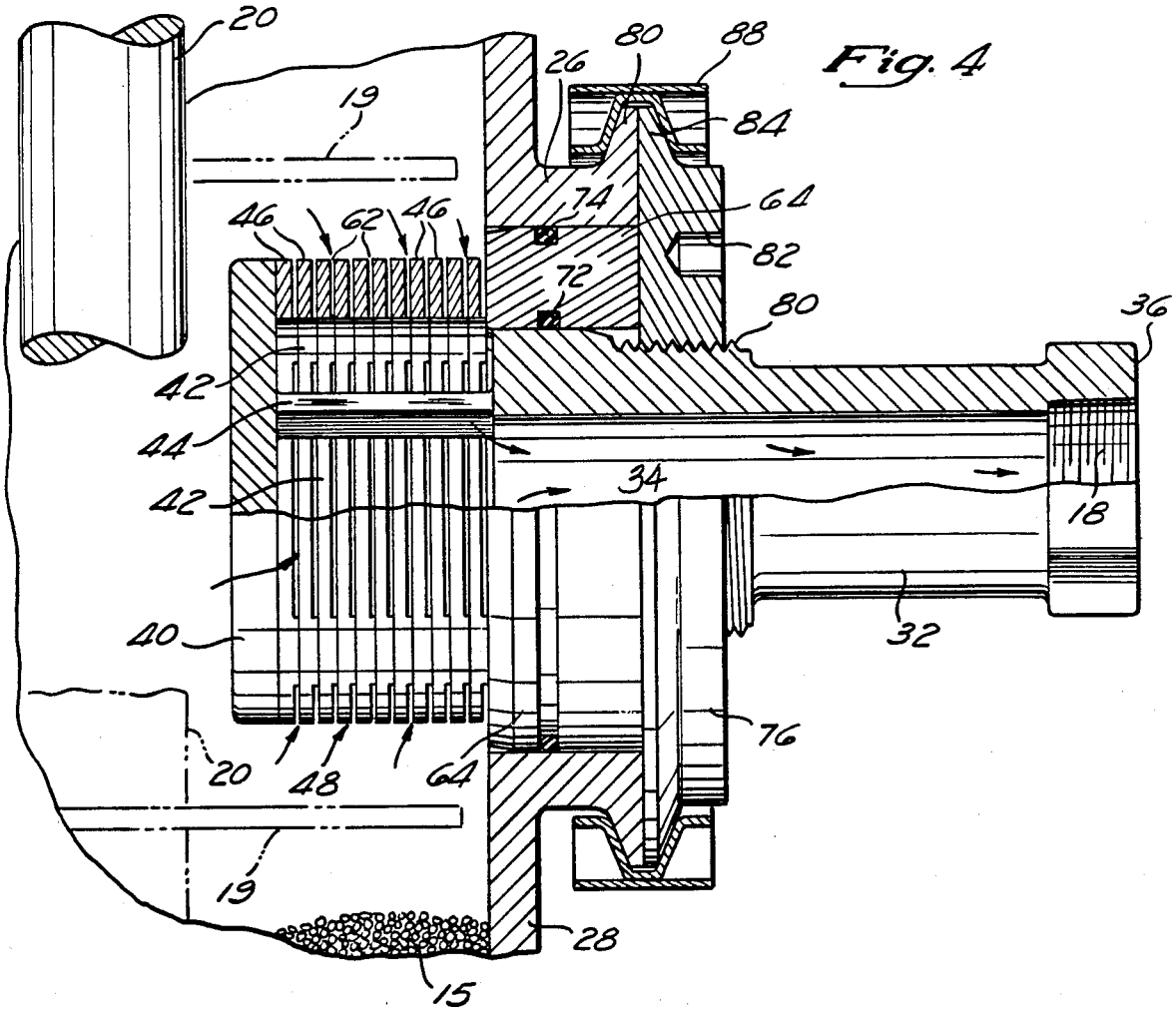
FIG. 4 is a cross-sectional assembly view of the present screen assembly as installed in the outlet structure shown in FIG. 2.

Referring to FIG. 1, a media mill 10 is shown mounted on a support housing 12. The media mill 10 includes a substantially cylindrical, vertically oriented vessel 14 having an inlet 16 at its bottom end and an outlet 18 near its upper end. A plurality of rotors 19, schematically shown in FIG. 4, are mounted on a rotatable, vertically oriented drive shaft 20 which extends through the top of the vessel 14. The shaft 20 is driven by a motor and a system of pulleys contained in the housing 12. Also within the vessel 14 is a grinding media 15, often referred to as sand, although it is typically a manufactured grit or shot.

The liquid product to be processed by the media mill 10 flows into the inlet 16, upwardly through the vessel 14, and out through the outlet 18 by means of a pump (not shown). While the product is being pumped through the vessel 14, the shaft 20 is rotated by the drive means so that the rotors 19 agitate the grinding media 15. Particles within the product are milled or ground so that the product exiting the vessel 14 is very fine and wellmixed.

To prevent the grinding media 15 from becoming suspended in the liquid product and exiting the vessel 14 through the outlet 18, the outlet 18 is formed as part of a screen assembly 22 (shown in FIG. 2). The screen assembly 22 is removably mounted within an outlet structure 24. The outlet structure 24 is a casting which forms an upper segment of the vessel 14 and has a tubular outlet housing 26 extending radially outward from the cylindrical body 28 of the outlet structure 24. The outlet housing 26 terminates in an open end 30 to form a passage into the vessel 14 through which the screen assembly 22 is inserted, as shown in FIG. 4. The outlet structure 24 can be used to retrofit existing media mills which are not adapted for use with the present screen assembly 22, but which have a removable upper segment on the vessel, such as the media mill shown in U.S. Pat. No. 4,441,698.

The screen assembly 22 includes a tubular carrier element 32 having an interior channel 34 shown in FIG. 4. The carrier 32 has an open outlet end 36 which is open to the interior channel 34 and forms the outlet 18. The other end of the carrier 32 forms a closed end 38 which terminates in a flat, preferably circular end plate 40 which is oriented in a plane normal to the central axis of the carrier 32. Adjacent the end plate 40, one or more windows 42 extend through the carrier 32 to allow fluid communication with the interior channel 34. The windows 42 are formed by the spaces between a set of ribs 44 which are spaced around the periphery of the carrier 32. The ribs 44 extend between the end plate 40 and the remainder of the carrier 32 and are parallel to the central axis of the carrier 32. While three ribs are shown, more or less could be employed.

The screen assembly 22 further includes a plurality of ring-shaped screen elements 46 which are positioned adjacently to form a cylindrical stack 48 which defines a cylindrical inner void, which may be visualized from FIG. 4. While rings of circular shape are believed to be the most practical, it should be understood that other enclosed shapes can be utilized. The ribs 44 extend through the inner void and support the screen elements 46 so that they are all coaxial with the central axis of the carrier 32. For support, the radially inner edge 50 of each screen element 46 rests on the radially outer edges 52 of the ribs 44. One end of the stack 48 abuts against the end plate 40, which has a diameter greater than the inside diameter of the screen elements 46 to prevent the stack from sliding off the closed end 38 of the carrier 32.

As is best shown in FIG. 3, an axial face of each screen element 46 has two sets of diametrically opposed slots 54 and 56. The slots 54 and 56 are separated by integral raised pads 58. The slots 54, 56 extend directly from the outside diameter of the screen elements 46 to the inside diameter. Each slot 54 or 56 has a pair of straight edges 60 which are parallel and colinear with the edges 60 of the other slot 54 or 56 which forms the pair. The alignment of the edges 60 in each pair of slots facilitates the milling of the slots 54, 56.

Referring to FIG. 4, when the screen elements 46 are stacked, the pads 58 of each screen element 46 abut against the flat, unslotted axial face of the adjacent screen elements 56 to form narrow, radially extending openings 62. The openings 62 are sufficiently narrow so that the grinding media cannot pass between the screen elements 46.

To mount the screen assembly 22 within the outlet housing 26, an annular spacer 64 is provided. One axial face of the spacer 64 abuts against the stack 48. The spacer 64 surrounds a cylindrical gland 66 on the carrier 32 which has a diameter that is approximately equal to the inside diamater of the spacer 64. Annular grooves 68 and 70 are provided on both the inner and outer radial faces of the spacer 64. An inner O-ring 72 and an outer O-ring 74 are placed in the grooves 68 and 70, respectively. The outside diameter of the spacer 64 is approximately equal to the inside diameter of the outlet housing 26, thus the outer O-ring 74 provides a seal between the spacer 64 and the outlet housing 26. Likewise, the inner O-ring 72 forms a seal between the spacer 64 and the gland 66 on the carrier 32. Thus, the open end 30 of the outlet housing 26 is completely sealed so that any liquid exiting the vessel 14 must pass through the screen elements 46 and into the interior channel 34.

The screen assembly 22 is fastened to the outlet housing 26 by means of an annular face plate 76. The face plate 76 has internal threading 78 which mates with external threading on a threaded portion 80 of the carrier 32. The face plate 76 has diametrically opposed sockets 82 which enable the face plate 76 to be rotated by a spanner wrench (not shown). When threaded onto the carrier 32, the face plate 76 acts as a nut and clamps the stack 48 between the end plate 40 and the spacer 64, thus preventing the screen elements 46 from becoming separated and the openings 62 from becoming wider.

The face plate 76 has a peripheral flange 84 which abuts against a mating peripheral flange 86 on the open end 30 of the outlet housing 26. The face plate 76 and screen assembly 22 are secured to the outlet housing 26 by means of a circular retainer ring 88 which surrounds the mating flanges 84 and 86. The retainer ring 88 is a quick disconnect type which allows the face plate 76 to be quickly fastened or unfastened from the outlet housing 26.

To install the screen assembly 32 within the outlet structure 24, a screen element 46 is slid over the outlet end 36 of the carrier 32 and abutted against the end plate 40. Other screen elements 46 are successively slid over the carrier 32 and abutted against each other to form the stack 48. There are enough screen elements 46 so that the stack 48 completely covers the windows 42. Alternatively, all of the screen elements 46 may be arranged in a stack 48 first and slid over the carrier 32 simultaneously.

Next, the spacer 64 is slid over the open end 36 of the carrier 32 and abutted against the end of the stack 48 so that the spacer 64 surrounds the gland 66 on the carrier 32. The face plate 76 is then threaded onto the threaded portion 80 of the carrier 32. The sockets 82 permit a spanner wrench to be used to tighten the face plate 76. The farther the face plate 76 is threaded along carrier 32, the tighter the spacer 64 is clamped between the stack 48 and the face plate 76. In turn, the stack 48 is clamped between the end plate 40 and the spacer 64, preventing the screen elements 46 from separating.

After the face plate 76 is tightly secured on the carrier 32, the closed end 38 of the carrier 32 is inserted through the open end 30 of the outlet housing 26. The carrier 32 is fed into the outlet housing 26 and until the face plate 76 abuts against the open end 30 of the outlet housing 26 with the face plate flange 84 and the outlet housing flange 86 mating. To retain the carrier 32 in that position, the retainer ring 88 is clamped around the flanges 84 and 86, as is shown in FIG. 4.

To remove the screen assembly 22 from the outlet housing 26 for cleaning or replacement, the above steps are reversed. The screen elements 46 are easily removed from the outlet housing 26 since they are remain together in a stacked formation along the carrier 32, and thus do not have to be individually manipulated. The assembly 22 is easy to handle by gripping the outlet end 36 of the carrier 32.

In operation, liquid product is pumped through the vessel 14 and passes through the openings 62. The grinding media is prevented from entering the openings 62 because the openings 62 are too narrow. After passing through the screen elements 46, the liquid flows through the window 42 into the interior channel 34, and exits through the outlet 18, as shown by the arrows in FIG. 4.

The spacer 64 is long enough so that when the screen assembly 22 is fully installed, the stack 48 extends beyond the outlet housing 26 and into the vessel 14. However, the stack 48 does not extend far enough into the vessel 14 to interfere with the operation of the shaft 20. The positioning of the stack 48 within the vessel 14 allows the majority of the openings 62 to be exposed directly to the flow of liquid through the vessel 14. As a result, little pressure build up results across the screen elements 46. In contrast, if the stack 48 were entirely surrounded by the outlet housing 26, some grinding media may collect between the outlet housing 26 and the stack 48. Further, the straight edges 60 of the slots 54, 56 create direct flow paths through the screen elements 46, which help to minimize the pressure drop across the screen elements 46.

Since the stack 48 is positioned within the vessel 14, the screen elements 46 are subject to more wear by the abrasive grinding media. However, due to the depth of the openings 62, as the exterior surface of the screen elements 46 are worn down, the openings 62 do not become any wider and will not allow individual particles of media to either become lodged within an opening 62 or pass through an opening 62.

Media of different sizes may be employed for different milling operations. Consequently, screen elements that provide larger or smaller openings 62 may be utilized. It is an easy matter to withdraw the screen assembly and replace the elements with a different set.

Figure 5:
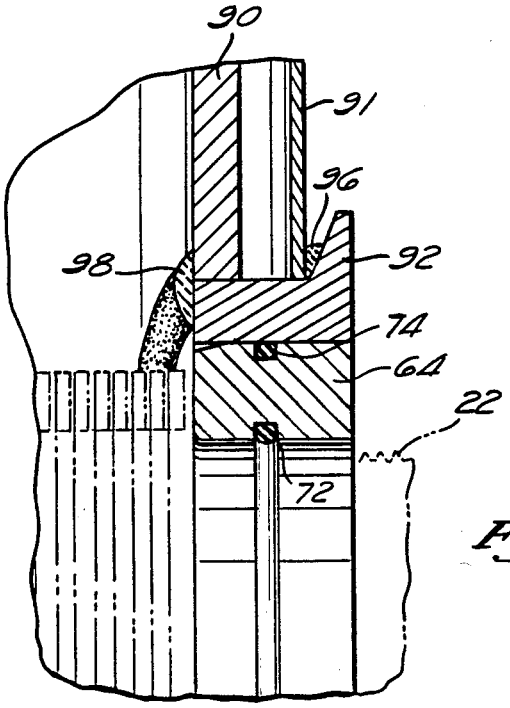
FIG. 5 is a cross-sectional view of an alternative embodiment of a vessel with the carrier and screen elements of the present screen assembly shown in broken lines.

Referring to FIG. 5, an alternative embodiment of the invention is shown. As opposed to the outlet structure 24 shown in FIG. 2 which is separate from the remainder of the vessel 14, FIG. 5 shows a one piece vessel 90 and surrounding water gasket 91 having an outlet housing 92 which is welded to an opening through the jacket 91 and the vessel 90 along exterior and interior beads 96 and 98, respectively. The spacer 64 and screen assembly 22 (shown in broken lines) are installed in the same manner as described above.

We claim:

1. A milling apparatus comprising:

a vessel for receiving grinding media and a liquid having small particles therein which are to be milled or reduced in size within the vessel;

a motor driven rotor in said vessel for agitating the grinding media;

a liquid inlet through which said liquid is introduced as the grinding media is agitated by the rotor;

a tubular liquid outlet housing extending radially outward from a passage through said vessel and terminating in an open end;

a plurality of ring-shaped screen elements arranged in a stack within said vessel;

a tubular carrier element extending through said outlet housing, said carrier element defining an interior channel and extending through said stack to support said screen elements so that all of the screen elements can be removed together upon the removal of said carrier, said carrier having one or more windows allowing fluid communication between said vessel and said interior channel, said screen elements surrounding said windows and having slots formed in their axial faces so that the slots and the adjacent screen elements define openings extending between said vessel and said interior channel, said openings being sized to prevent the grinding media from passing into the openings as said liquid flows radially inward through said stack and windows and into said interior channel;

an outlet formed by an end of said carrier which is open and terminates outside of said vessel, liquid exiting the vessel through said outlet; and means for removably fastening said carrier element to said outlet housing so that said carrier and screen elements can be quickly and easily removed.

2. The apparatus of claim 1, wherein said carrier and screen elements extend through said outlet housing and into the interior of said vessel to maximize the surface area of said openings which are directly within the flow path of the liquid.

3. The apparatus of claim 2, wherein said vessel is substantially vertically oriented and said screen elements are stacked along a substantially horizontally oriented axis.

4. The apparatus of claim 1, wherein said fastening means comprises an annular face plate which abuts the open end of said outlet housing, said face plate having internal threading, said carrier extending through said face plate and having external threading which mates with said face plate threading and wherein the open end of the outlet housing has an outwardly extending flange, the face plate has a peripheral flange which abuts the outlet flange, and a quick-disconnect retaining ring surrounds the mating face plate flange and the outlet flange to secure said face plate to said outlet housing.

5. The apparatus of claim 4, wherein said face plate includes a pair of diametrically-spaced sockets which are adapted for use with a spanner wrench to rotatably thread said face plate along said carrier.

6. The apparatus of claim 4, further comprising means for spacing said stack of screen elements from said face plate so that said screen elements extend beyond said outlet housing and into the interior of said vessel.

7. The apparatus of claim 6, wherein said spacing means comprises an annular spacer element within said outlet housing, the inside diameter of said spacer being large enough so that said spacer slides over said carrier, one axial face of said spacer abutting against one end of said stack of screen members, the other axial face of said spacer abutting against the face plate, a substantially flat end plate on the other end of said carrier, said end plate forming a closed end of the carrier and extending beyond the exterior of said carrier so that the other end of said stack of screen elements abuts against said end plate and threading said face plate onto said carrier clamps said stack between said spacer and said end plate, preventing said screen elements from being separated, said spacer spacing said stack of screen elements from the face plate so that the carrier and the screen elements extend beyond said inlet housing and into the interior of said vessel.

8. The apparatus of claim 7, wherein said spacer further includes a circumferential groove on both the inner and outer radial faces, and an O-ring within each of said grooves, the inner O-ring forming a seal between said carrier and said spacer, the outer O-ring forming a seal between said outlet housing and said spacer.

9. The apparatus of claim 1, wherein said windows are formed by the spaces between a set of circumferentially spaced ribs which extend parallel to the central axis of said carrier, said ribs having radially outer edges on which the radially inner edges of said screen elements rest.

10. The apparatus of claim 9, wherein the other end of said carrier is closed by a flat end plate which is orthogonal to the central axis of said carrier, said ribs extending from said end plate to said carrier.

11. The apparatus of claim 1, wherein said screen elements have a plurality of radially extending slots separated by pads which provide the structure for holding said openings open when the screen elements are stacked together.

12. The apparatus of claim 11, wherein said slots include at least one pair of diametrically opposite slots with straight edges.

13. The apparatus of claim 1, wherein the tubular outlet portion and a segment of the vessel are formed as a single casting.

14. A milling apparatus comprising:

a generally cylindrical and vertically oriented vessel for receiving grinding media and a liquid having small particles therein which are to be milled or reduced in size within the vessel;

a motor-driven rotor in the vessel for agitating the grinding media;

a liquid inlet through which said liquid is introduced as the grinding media is agitated by the rotor;

a cylindrical outlet housing extending radially outward from said vessel and having an axis which is substantially transverse to the axis of said vessel, said outlet housing terminating in an open end;

an outlet screen assembly which permits the liquid to exit from the vessel while preventing the media from exiting the vessel, said screen assembly being (i) easily removable to facilitate cleaning and replacement; (ii) positioned within the interior of the vessel so as to be directly exposed to the flow of liquid; and (iii) able to withstand the wear imposed by the grinding media without permitting the media to exit the vessel, said screen assembly comprising;

an elongated, tubular carrier element passing through said outlet housing, said carrier having an interior cavity, one end of said carrier being open and extending out of said housing to form an outlet through which liquid exits the vessel, the other end of said carrier being closed and extending into the interior of said vessel;

a plurality of ring-shaped screen elements stacked together near said closed end of said carrier, one end of said stack abutting against a flat, planar end plate which forms said closed end, said end plate being in a plane which is oriented orthogonal to the central axis of said carrier, said carrier having a plurality of windows therein which allow fluid communication between said vessel and said interior cavity, said screen elements surrounding said windows and having slots formed in their axial faces so that the slots and the adjacent screen elements define openings extending between said vessel and said interior cavity, said openings being sized to prevent the grinding media from passing into the openings as said liquid flows radially inward through said stack of screen elements, said openings being relatively straight and direct to minimize pressure drop across the openings and to minimize clogging of said opening by media particles or product;

an annular face plate which abuts against the open end of said outlet housing, said outlet end and said face plate having mating, circular, peripheral flanges, said face plate having internal threading, a portion of said carrier having external threading, said face plate threading mating with said carrier threading;

an easily removable circular retainer ring surrounding said outlet housing flange and said face plate flange;

an annular spacer element surrounding said carrier and positioned within said outlet housing so that the radially inner surface of said spacer is in sealing engagement with said carrier and the radially outer surface of said spacer is in sealing engagement with said outlet housing, said spacer having an inner axial face which abuts against the other end of the stack of screen members and an outer axial face which abuts against said face plate so as to maintain said screen members from separating and to space said screen elements from the open end of said outlet housing so that the majority of the openings formed by said screen elements are within the interior of said vessel.

* * * * *